US005205672A

United States Patent [19]

Stinton

[11] Patent Number: 5,205,672

[45] Date of Patent: Apr. 27, 1993

[54] DIVER'S WEIGHT ASSEMBLY

[75] Inventor: Robert T. Stinton, Lakeside, Calif.

[73] Assignee: Diving Unlimited International, Inc., San Diego, Calif.

[21] Appl. No.: 820,362

[22] Filed: Jan. 14, 1992

[51] Int. Cl.[5] ..... B63C 11/30

[52] U.S. Cl. ..... 405/186

[58] Field of Search ..... 405/185, 186; 2/311, 2/312; 441/80, 106, 108

[56] References Cited

U.S. PATENT DOCUMENTS

| | | | |
|---|---|---|---|
| 3,220,197 | 11/1965 | Christiansen | 405/186 |
| 3,263,432 | 8/1966 | Maskell | 405/186 |
| 3,401,529 | 9/1968 | Fifield | 405/186 |
| 3,648,324 | 3/1972 | Stradella et al. | 405/186 X |
| 3,808,824 | 5/1974 | Johnston et al. | 405/186 |
| 4,440,525 | 4/1984 | Perla | 405/186 |
| 4,887,932 | 12/1989 | Toth | 405/186 |
| 5,074,714 | 12/1991 | Franco | 405/186 |

*Primary Examiner*—David H. Corbin

*Attorney, Agent, or Firm*—Brown, Martin, Haller & McClain

[57] ABSTRACT

A diver's weight assembly for attaching diver's weights to a belt includes one or more weight packs and an attachment and quick release mechanism for attaching each weight pack to a belt. The attachment and release mechanism includes a fastener assembly releasably securing the weight pack to the belt, and a release device for releasing the fastener assembly. The release device has a handle for operating the release device, and the handle is secured to the weight pack so that the weight pack can be pulled away from the body via the handle once released.

18 Claims, 3 Drawing Sheets

DIVER'S WEIGHT ASSEMBLY

BACKGROUND OF THE INVENTION

The present invention relates to diver's weight systems for attaching weights to a diver's body so as to achieve neutral buoyancy.

The traditional weight belt is the most widely used device in diving for enabling a diver to increase their weight by the amount needed to achieve neutral buoyancy. This consists of a single strap or belt worn around the diver's waist with a selected number of weights attached to the belt by various means, such as pockets on the belt. The belt must be worn snugly around the waist to ensure that it stays in position. If worn too loosely, the weights pulling downwardly on the belt may cause it to slip down and potentially even slip off the diver. One advantage to the weight belt is that it can be released quickly in an emergency situation, allowing the diver to achieve positive buoyancy more or less immediately if needed. Thus, the diver merely releases the belt and pulls it away from their body before dropping it. One disadvantage of this is that the belt falls straight down and may become entangled with the diver's legs or feet. Also, in view of the fact that the diver must be able to release the belt easily when diving, the belt fastener must be of a quick release type, resulting in a risk of accidental release. Additionally, in some situations a diver may want to achieve positive buoyancy without dropping all of the weights. This is not possible with a conventional weight belt as commonly used in recreational diving.

The second known weight system for diving is the commercial weight harness as commonly used in commercial diving applications. In commercial diving applications, a large capacity weight system is often needed. Also, accidental loss of the weight belt could result in personal injury to the diver in such applications. The weight harness avoids or at least reduces the risk of accidental loss of weights. The harness consists of a belt affixed around the waist as well as shoulder straps extending from the belt over the diver's shoulders to keep the belt in position and prevent it from slipping off. The weights are attached to the belt in a similar manner to a standard weight belt. One disadvantage of the weight harness is that in the event of an emergency the weights cannot be dropped to achieve positive buoyancy rapidly.

Weight release systems for harnesses exist in which the bottom of the pocket carrying the weights is opened. This has the disadvantage that gravity is required to get the weight out of the pocket, so the system is attitude sensitive and will only work if the diver is near vertical in the water. There is also a risk of the released weights striking portions of the diver's body or becoming entangled with the diver as they fall directly down.

SUMMARY OF THE INVENTION

It is an object of the present invention to provide a new and improved diver's weight assembly.

According to the present invention, a diver's weight assembly is provided which comprises a belt for fitting around a diver's waist, at least one weight device for attachment to the belt, a securing mechanism for releasably securing the weight device to the belt, and a release mechanism for releasing the securing mechanism, the release mechanism being secured to the weight device for allowing the weight device to be pulled away from the diver's body when released.

Preferably, more than one weight device is provided, each with its own release mechanism having a handle for actuating the release mechanism, so that the diver can choose whether to drop all or only some of the weights carried on the belt. In a preferred embodiment of the invention, one weight device is attached at each side of the belt, so that the diver can simultaneously pull both weight devices away by gripping and pulling the release handles with both hands. The weight devices may comprise pocket members each having one or more pockets for receiving selected weights to provide the diver with the necessary additional weight to achieve negative buoyancy.

In a preferred embodiment of the invention, the assembly includes shoulder straps extending from the belt over the diver's shoulders to prevent the belt from slipping down or rotating around the diver's body. The straps are of adjustable length to allow the weights to be adjusted to an optimum position for each diver. This allows the diver to change the relationship between the center of buoyancy and the center of gravity, allowing control over both trim and attitude in the water.

Preferably, the attachment or securing mechanism comprises a hook-and-eye-like interengagement between the belt and weight device, with eyes or loops extending from the weight device through corresponding openings provided on the belt. A release cable threaded through the extending ends of the loops affixes the weight device to the belt. The release mechanism comprises a release handle secured to the cable for pulling the cable out of the loops. The release handle is also secured to the weight device so that it can be pulled away from the belt when the loops are released, and also away from the diver's body to reduce the possibility of accidental entanglement.

The diver's weight system of this invention is not attitude sensitive, and allows a diver to quickly and easily drop some or all of their weights if necessary. The diver can pull the weights clear of their body before dropping them, reducing the risk of entanglement.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
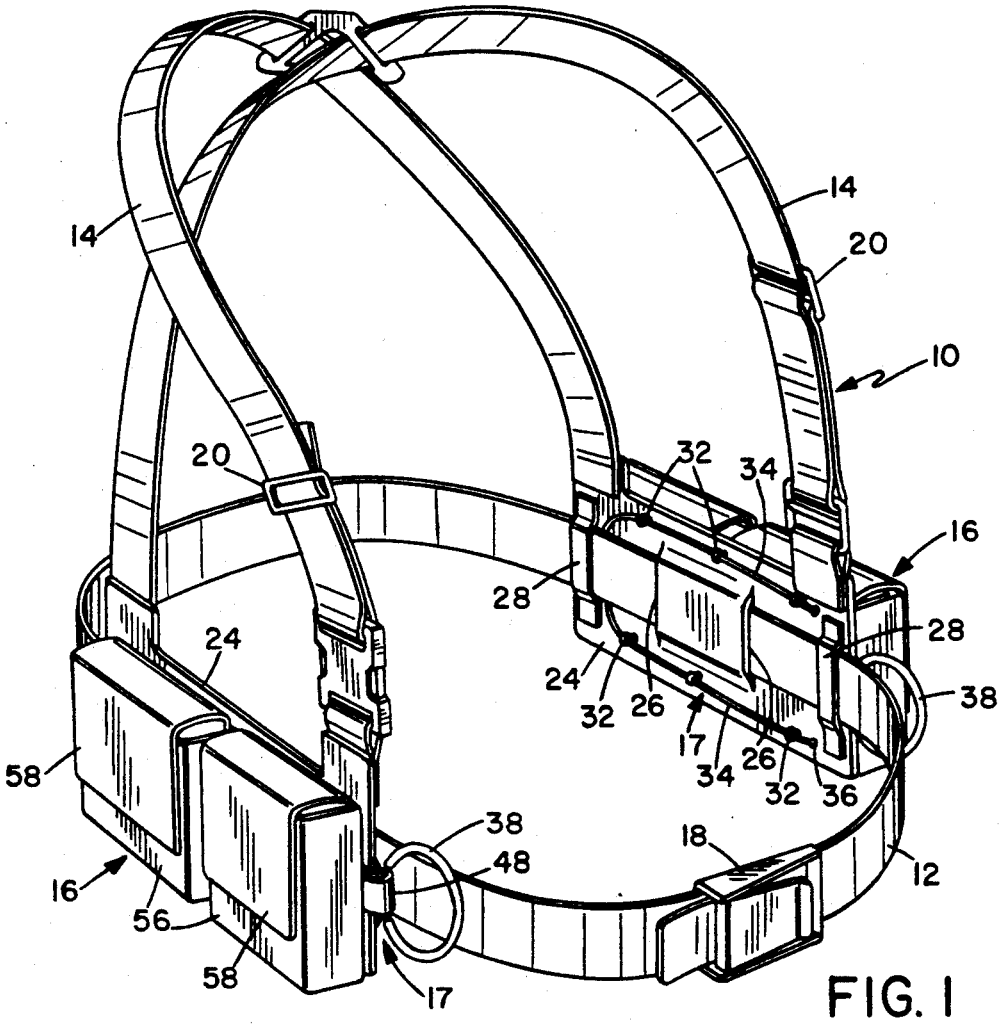
FIG. 1 is a pictorial view of a body harness weight belt according to a preferred embodiment of the present invention with quick-release weight packs attached.

FIG. 1 of the drawings illustrates a body harness for wearing by a diver with a belt 12 for fitting around the diver's waist and shoulder straps 14 extending from the belt for engaging over a diver's shoulders. A pair of quick release weight devices or packs 16 are releasably secured to the belt on each side of the harness by means of attachment and release mechanism 17 so that they will be positioned one on each side of the diver's body when the harness is donned. A suitable fastener or buckle 18 of a standard type is provided for releasably fastening the belt around the diver's body. The fastener is of the type allowing adjustment of the length of the waist belt. Similar length adjustment loops or buckles 20 are provided on the shoulder straps to allow the length of the shoulder straps to be adjusted.

The attachment and quick release mechanism 17 of one of the weight packs 16 is illustrated in more detail in FIGS. 2 to 7. It will be understood that the other weight pack is attached and released in an identical manner, and like reference numerals are used in FIG. 1 as appropriate.

Figure 2:
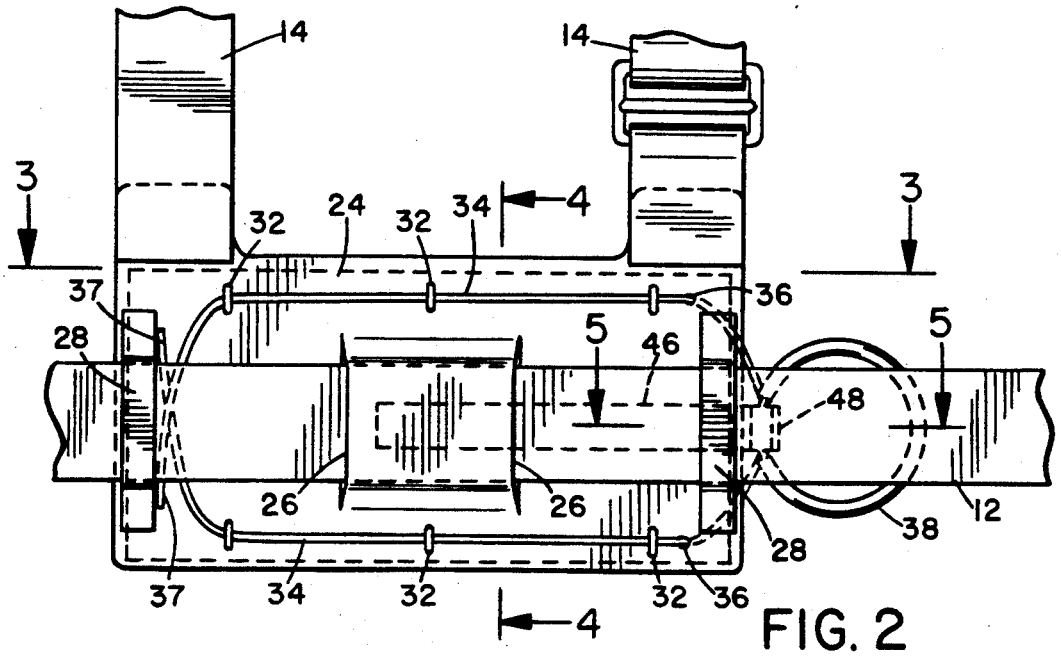
FIG. 2 is an inside elevation view of one weight pack mounting.
Figure 4:
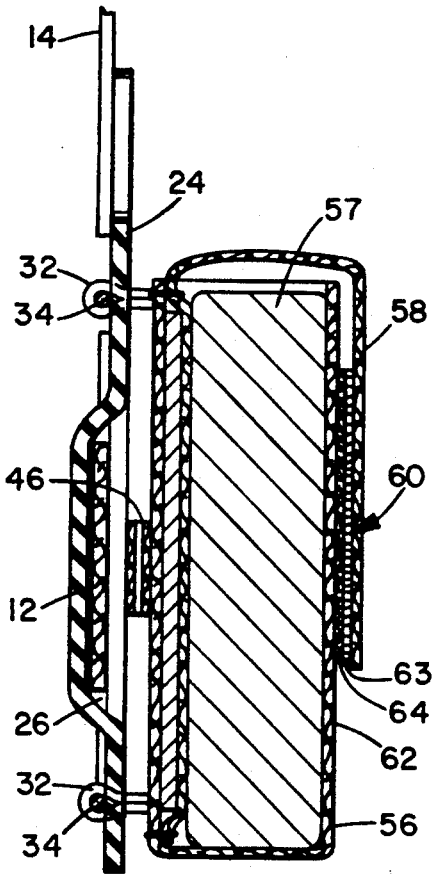
FIG. 4 is an enlarged sectional view taken on line 4—4 of FIG. 2.

The mechanism 17 includes a base panel 24 of cloth reinforced rubber material or the like mounted on the belt 12 via slits 26 and belt loops 28 through which the belt is threaded, as illustrated in FIGS. 1 and 2. Panel 24 has a series of openings 30 through which eyes or loops 32 projecting from the rear face of the weight pack 16 extend, as illustrated in FIGS. 2 and 4. A release cable 34 is threaded through the projecting ends of loops 32 on the opposite face of the base panel to the weight pack, thus securing the weight pack to the belt. As best illustrated in FIG. 2, the loops and associated openings 30 are arranged in a pair of spaced rows positioned above and below the belt, respectively. An additional opening 36 is provided in the panel 24 at the end of each row closest to the belt buckle or front of the belt. The opposite ends 37 of cable 34 are threaded first from the front or outwardly-facing side of the panel through the respective anchor openings 36, and are then threaded through the loops 32 in the respective rows to the end of the row. The free ends 37 are then simply bent towards one another and crossed over between the belt and panel so that pressure between the belt and panel will tend to hold the cable ends in place and avoid accidental release.

Figure 3:
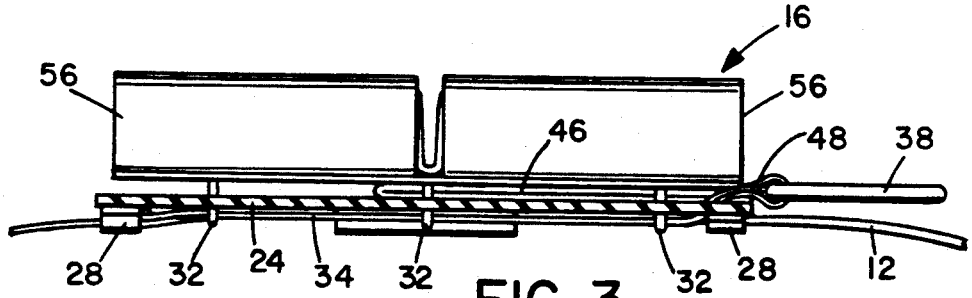
FIG. 3 is a sectional view taken on line 3—3 of FIG. 2.
Figure 6:
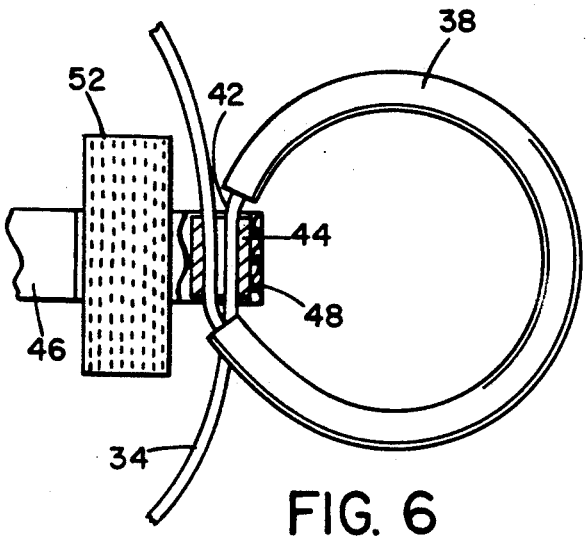
FIG. 6 is a side elevation view of the release pull handle, with a portion cut away.
Figure 5:
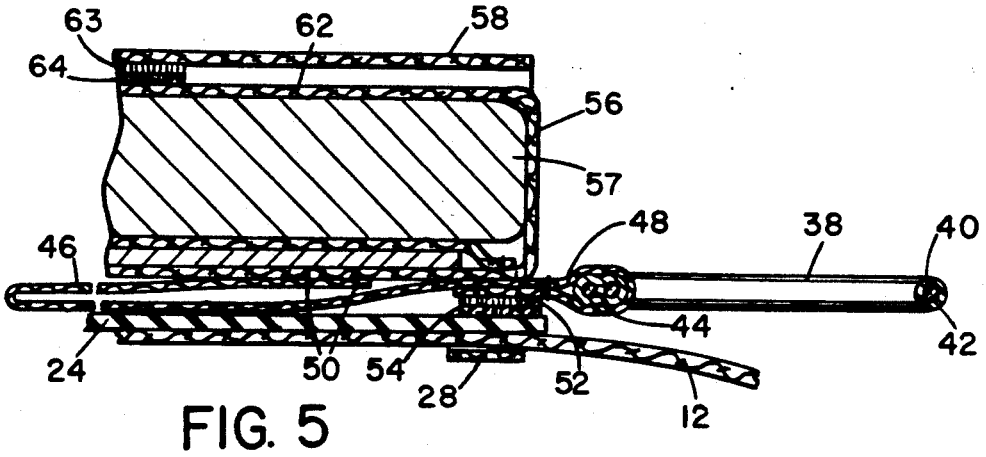
FIG. 5 is an enlarged sectional view taken on line 5—5 of FIG. 2.

The release mechanism is best illustrated in FIGS. 5 and 6, and comprises a release handle 38 mounted on a loop 42 in a central portion of the release cable 34. The handle comprises a part-circular plastic member having a through bore 40 through which the cable loop 42 extends, with the cable extending from opposite ends of the handle in opposite directions through anchor member 44 to prevent slipping, as best illustrated in FIG. 6. The handle 38 is also secured to the weight pack 16 via a lanyard or line 46 secured to the handle via loop 48 at one end and secured via stitching 50 or the like to the back of the weight pack, as best illustrated in FIG. 5. The handle is also releasably secured to the belt panel via mating strips 52, 54 of releasable hook and loop fastener material such as Velcro® secured to the handle end of the lanyard and belt panel, respectively, as best illustrated in FIG. 5. This also avoids accidental release of the weight back. When the belt pack is secured to the belt, the lanyard 46 will be doubled over between the weight pack and panel, as illustrated in FIGS. 3 and 5.

As illustrated in FIG. 1, each shoulder strap 14 is preferably secured at one end to one upper corner of one of the panels 24 and at the opposite end to the opposite upper corner of the other panel 24, the straps crossing over at the rear of a wearer's body and being secured together at the crossover point by connector piece 35. This arrangement allows an existing conventional weight belt to be converted to a shoulder harness, with all the resultant advantages of avoiding slipping and twisting of the belt. However, the weight pack and quick release mechanism could also be used on a shoulder harness which already has shoulder straps, simply by attaching panels 24 without any shoulder straps 14 to the waist belt of a shoulder harness.

Thus, the attachment and release mechanism 17 may be used to mount the weight pack on any diver's weight belt or harness, with the waist belt simply being extended through the belt loops and slots of the panels 24 as illustrated in the drawings. This not only provides a quick release weight system for added safety, but also converts a waist belt to a shoulder harness. For an existing harness, the straps 14 secured to panels 24 would be omitted.

Each weight pack 16 is preferably a pocket member having at least two pockets 56 each having a capacity for holding up to 10 lbs of weight 57 such as lead in the form of solid lead or bags of lead shot, as is commonly used for diving weights. Each pocket has a closure flap 58 with a releasable fastener 60 between the flap and outer face 62 of the pocket for releasably holding the flap down, as illustrated in FIG. 4. The fastener preferably comprises interengageable strips 63, 64 of releasable hook and loop fastener material such as Velcro®. This allows adjustment of the pocket size to fit the pocket contents, by overlapping the mating Velcro® strips on the flap and pocket by varying amounts. With a two pocket weight pack 16 on each side of the belt, a weight capacity of up to 40 lbs is provided.

Figure 7:
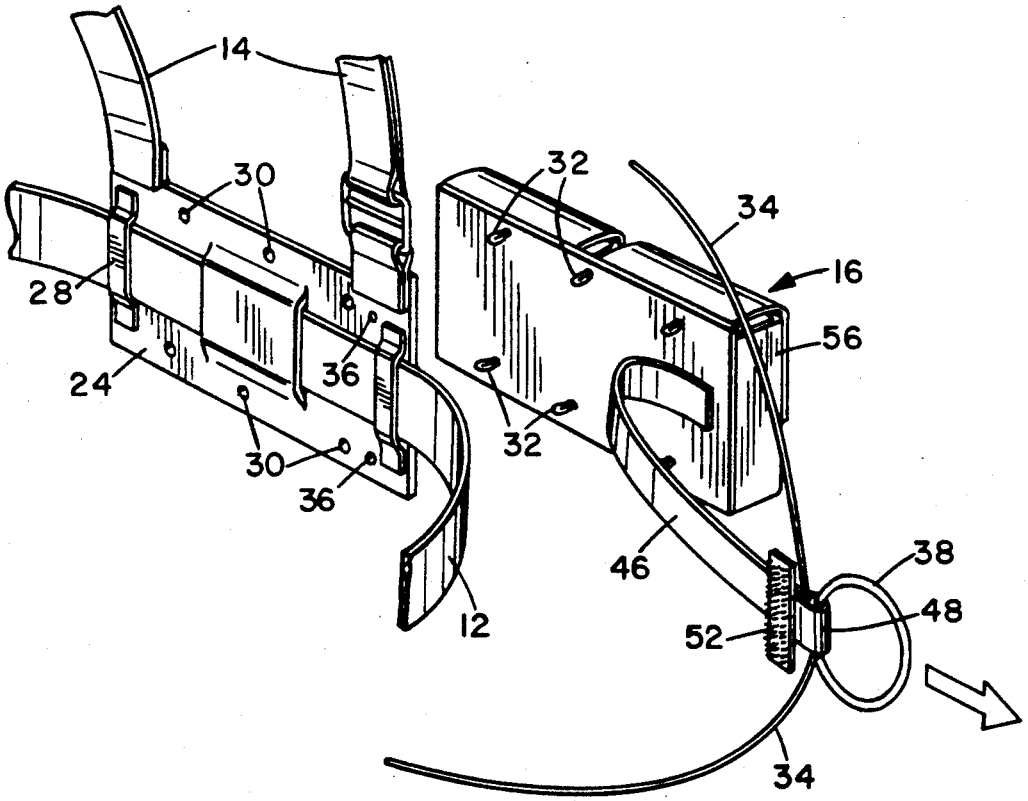
FIG. 7 is a view similar to a portion of FIG. 1, showing detachment of one weight pack.

When a diver needs to drop some or all of their weights quickly, they simply grip one or both of the release handles and pull sharply forwards. This simultaneously releases the Velcro® fastener 52 from the mating fastener 54 on the belt, and pulls the cable 34 out of the loops 32 so that the weight pack 16 can be pulled away from the panel 24 via lanyard 46, the loops 32 being pulled out of the openings 30 in the panel 24, as illustrated in FIG. 7. The weight pack can then be pulled away from the diver's body via the handle and lanyard before releasing the weights, reducing the risk of the weights accidentally becoming entangled with the diver's legs or other diving equipment. Thus, the lanyard allows the diver to pull the weight pack clear of the diver before releasing. The same action can be used to drop one or both weight packs, depending on the diver's needs.

The harness 10 with adjustable shoulder straps prevents the weight belt 12 from slipping down or rotating around the body, which is a common problem and cause of discomfort in divers using traditional weight belts. Thus, the belt 12 does not have to be worn very snugly around the waist, as is the case with a traditional weight belt. Load is distributed at the waist and shoulders for added comfort. By adjusting the length of the shoulder straps, the diver can change the position of the weights, thus changing the relationship between the center of buoyancy and the center of gravity and allowing control over trim and attitude in the water. This arrangement combines the advantages of a conventional diving waist belt and harness, by allowing the weights to be dropped quickly from the belt without having to remove the belt or harness, so that shoulder straps can be used for added comfort and adjustability without reducing the speed at which weights can be dropped when necessary. Another advantage to the system of this invention is that the diver does not have to drop all carried weights, but may choose to drop only half of the weights, for example, in some circumstances.

Although a preferred embodiment of the invention has been described above by way of example only, it will be understood by those skilled in the field that modifications may be made to the disclosed embodiment without departing from the scope of the invention, which is defined by the appended claims.

I claim:

1. A diver's weight assembly, comprising:

a belt for fitting around a diver's waist;

at least one weight pack for attaching to the belt;

an attachment and release mechanism for releasably attaching the weight pack to the belt, the mechanism including interengageable fastener means for attaching the weight pack to the belt, and release means for releasing the fastener means to separate the weight pack from the belt; and the release means including a handle for pulling by the wearer to actuate the release mechanism, and a lanyard securing the handle directly to the weight pack to allow the weight pack to be pulled away from the diver when released.

2. The assembly as claimed in claim 1, wherein said lanyard is connected to the handle at one end and to the weight pack at the other end, and further including releasable securing means for releasably securing the lanyard to the belt, the handle further comprising means for releasing the lanyard from the belt.

3. The assembly as claimed in claim 1, including two weight packs, and separate attachment and release mechanisms for releasably securing each weight pack to the belt.

4. The assembly as claimed in claim 1, including shoulder straps extending from the belt for engaging over a diver's shoulders.

5. The assembly as claimed in claim 1, wherein the weight pack has a plurality of pockets for selectively receiving weights up to a predetermined total weight value.

6. The assembly as claimed in claim 5, wherein each pocket has a closure flap for releasably closing the pocket, and adjustable fastener means for releasably fastening the flap to an outer surface of the pocket.

7. A diver's weight assembly, comprising:

a belt for fitting around a diver's waist;

at least one weight pack for attaching to the belt;

an attachment and release mechanism for releasably attaching the weight pack to the belt, the mechanism including interengageable fastener means for attaching the weight pack to the belt, and release means for releasing the fastener means to separate the weight pack from the belt;

the release means including a handle for pulling by the wearer to actuate the release mechanism, and the handle being secured to the weight pack to allow the weight pack to be pulled away from the diver when released; and the belt having a plurality of openings at a predetermined location for attachment of a weight pack, the interengageable fastener means comprising a plurality of loops projecting from the weight pack for extending through said openings, and the release means comprising a release cable extending through the projecting ends of the loops, the handle being secured to the cable for pulling the cable out of the loops to release the weight pack.

8. The assembly as claimed in claim 7, including at least one panel member slidably mounted on the belt, said openings being provided in the panel member.

9. The assembly as claimed in claim 8, including two weight packs and two panel members, each weight pack being releasably secured to a respective one of said panel members and the panel members being slidably mounted on the belt so as to be positioned on opposite sides of a diver's body when the belt is secured around the diver's waist.

10. The assembly as claimed in claim 9, including a shoulder harness assembly secured between said panel members for extending over a diver's shoulder when the belt is secured around a diver's waist.

11. The assembly as claimed in claim 10, wherein said shoulder harness comprises a pair of shoulder straps secured between said panel members for extending over a diver's shoulders, each shoulder strap being secured at one end to one of said panel members and at the other end to the other panel member.

12. An attachment and release assembly for releasably attaching diver's weights to a belt, comprising:

a weight pack for holding a selected amount of weight;

a panel member having openings for threading onto a belt;

interengageable fastener means on the weight pack and panel member for releasably attaching the weight pack to the panel member; and release means for releasing said fastener means to allow the weight pack to be separated from the panel member;

the release means including a handle for pulling by the wearer to actuate the release means, the handle being secured to the weight pack for pulling the weight pack away from a diver's body when released.

13. The assembly as claimed in claim 12, including a second weight pack and panel member having second interengageable fastener means for releasably securing the second weight pack tot he second panel member and second release means for releasing said fastener means, and a shoulder harness assembly extending between said first mentioned panel member and second panel member for engaging over a wearer's shoulder when said panel members are threaded onto a belt.

14. The assembly as claimed in claim 12, wherein said panel member has a plurality of openings, and said fastener means comprises a plurality of loops projecting from said weight pack for extending through said openings in said panel member, said release means comprising a release cable threaded through the projecting ends of said loops, and said handle comprising means for pulling the cable out of the loops.

15. The assembly as claimed in claim 12, including a lanyard connected at one end to the handle and at the other end to the weight pack.

16. The assembly as claimed in claim 14, including releasable fastener means for releasably securing the handle to the panel member.

17. The assembly as claimed in claim 14, wherein said panel member has two rows of openings, and said cable has a first end threaded through loops projecting through openings in one of said rows, a second end threaded through loops projecting through openings in the other row, and a central portion projecting away from said panel member, said handle being secured to said central portion, and said handle and panel member having releasable fastener means for releasably securing the handle to the panel member.

18. The assembly as claimed in claim 17, wherein said handle comprises a part-circular member having a through bore, said central portion of said cable extending through said handle bore.

* * * * *